US011209213B2

(12) United States Patent
Kim et al.

(10) Patent No.: US 11,209,213 B2
(45) Date of Patent: Dec. 28, 2021

(54) HEAT EXCHANGER

(71) Applicant: LG CHEM, LTD., Seoul (KR)

(72) Inventors: Sun Young Kim, Daejeon (KR); Jong Hyuk Park, Daejeon (KR); Ye Hoon Im, Daejeon (KR); Jeong Hyuk Won, Daejeon (KR); Jun Won Choi, Daejeon (KR); Min Su Kang, Daejeon (KR)

(73) Assignee: LG CHEM, LTD., Seoul (KR)

( * ) Notice: Subject to any disclaimer, the term of this patent is extended or adjusted under 35 U.S.C. 154(b) by 0 days.

(21) Appl. No.: 16/759,290

(22) PCT Filed: Nov. 15, 2018

(86) PCT No.: PCT/KR2018/014009
§ 371 (c)(1),
(2) Date: Apr. 24, 2020

(87) PCT Pub. No.: WO2019/098711
PCT Pub. Date: May 23, 2019

(65) Prior Publication Data

US 2021/0123683 A1 Apr. 29, 2021

(30) Foreign Application Priority Data

Nov. 17, 2017 (KR) ..... 10-2017-0154062

(51) Int. Cl.
*F28F 9/02* (2006.01)
*F28D 7/16* (2006.01)

(52) U.S. Cl.
CPC ..... *F28D 7/16* (2013.01); *F28F 9/0268* (2013.01)

(58) Field of Classification Search
CPC ..... F28D 7/16; F28F 9/0268
USPC ..... 165/175
See application file for complete search history.

(56) References Cited

U.S. PATENT DOCUMENTS

| | | | |
|---|---|---|---|
| 2,611,685 | A | 9/1952 | Yoder |
| 5,165,452 | A | 11/1992 | Cheng |
| 6,845,813 | B1 | 1/2005 | Knight et al. |
| 2005/0262850 | A1 | 12/2005 | Knight et al. |
| 2009/0056908 | A1 | 3/2009 | Halbe et al. |

(Continued)

FOREIGN PATENT DOCUMENTS

| | | | |
|---|---|---|---|
| CN | 103575153 | A | 2/2014 |
| DE | 4343806 | A1 * | 6/1995 |
| FR | 3 016 027 | A1 | 7/2015 |

(Continued)

*Primary Examiner* — Davis D Hwu
(74) *Attorney, Agent, or Firm* — Dentons US LLP

(57) ABSTRACT

A heat exchanger including: an inlet portion having a first flow path through which a fluid is introduced; a main body including a shell and a plurality of tubes. The shell has an internal space and one surface that has a plurality of penetration holes and a cross-sectional area larger than a cross-sectional area of the first flow path. Each of the plurality of tubes allows the fluid to flow therethrough, and is positioned in the internal space of the shell. An expanded tube portion connects the inlet portion and the one surface of the shell and has a second flow path. The heat exchanger also includes a fluid flow distributor disposed in the second flow path to distribute the flow of the fluid. No other member is disposed between the inlet portion and the multiple ring members.

9 Claims, 4 Drawing Sheets

(56) References Cited

U.S. PATENT DOCUMENTS

| | | | | |
|---|---|---|---|---|
| 2009/0065185 | A1* | 3/2009 | Jekerle | F28D 7/106<br>165/175 |
| 2013/0265848 | A1 | 10/2013 | Wurz et al. | |

FOREIGN PATENT DOCUMENTS

| | | | |
|---|---|---|---|
| JP | 4523748 | Y | 9/1970 |
| JP | 55165986 | Y | 12/1980 |
| JP | 02195196 | A | 8/1990 |
| JP | 2007-170271 | A | 7/2007 |
| KR | 20-0371015 | Y1 | 12/2004 |
| KR | 10-2015-0004531 | A | 1/2015 |
| KR | 10-1483878 | B1 | 1/2015 |
| WO | 0061278 | A1 | 10/2000 |
| WO | 02/090860 | A1 | 11/2002 |
| WO | 2011/151323 | A2 | 12/2011 |
| WO | 2017/008108 | A1 | 1/2017 |

* cited by examiner

[FIG. 1]
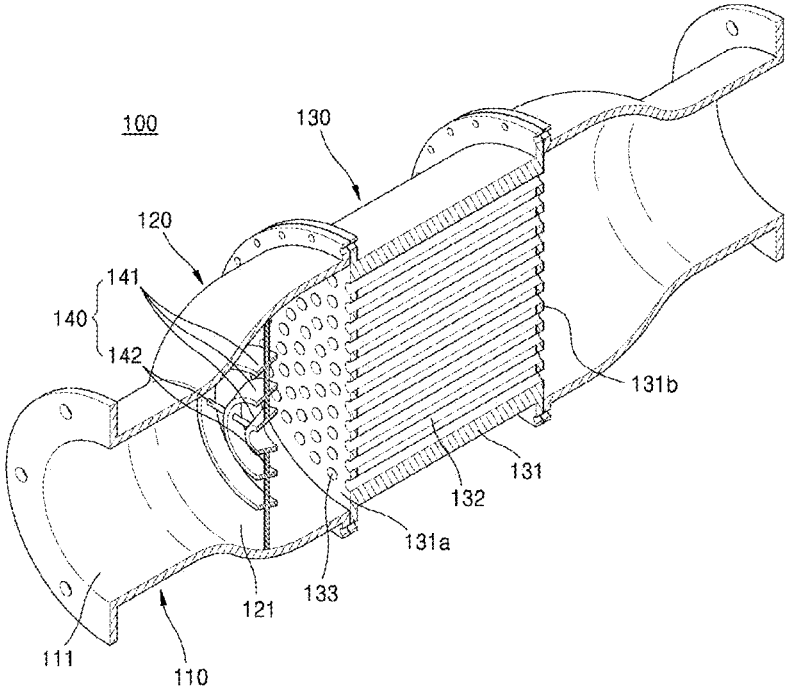
[FIG. 2]
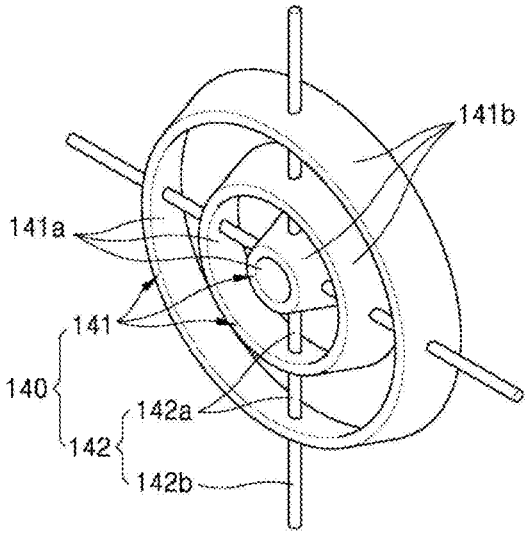

[FIG. 3]
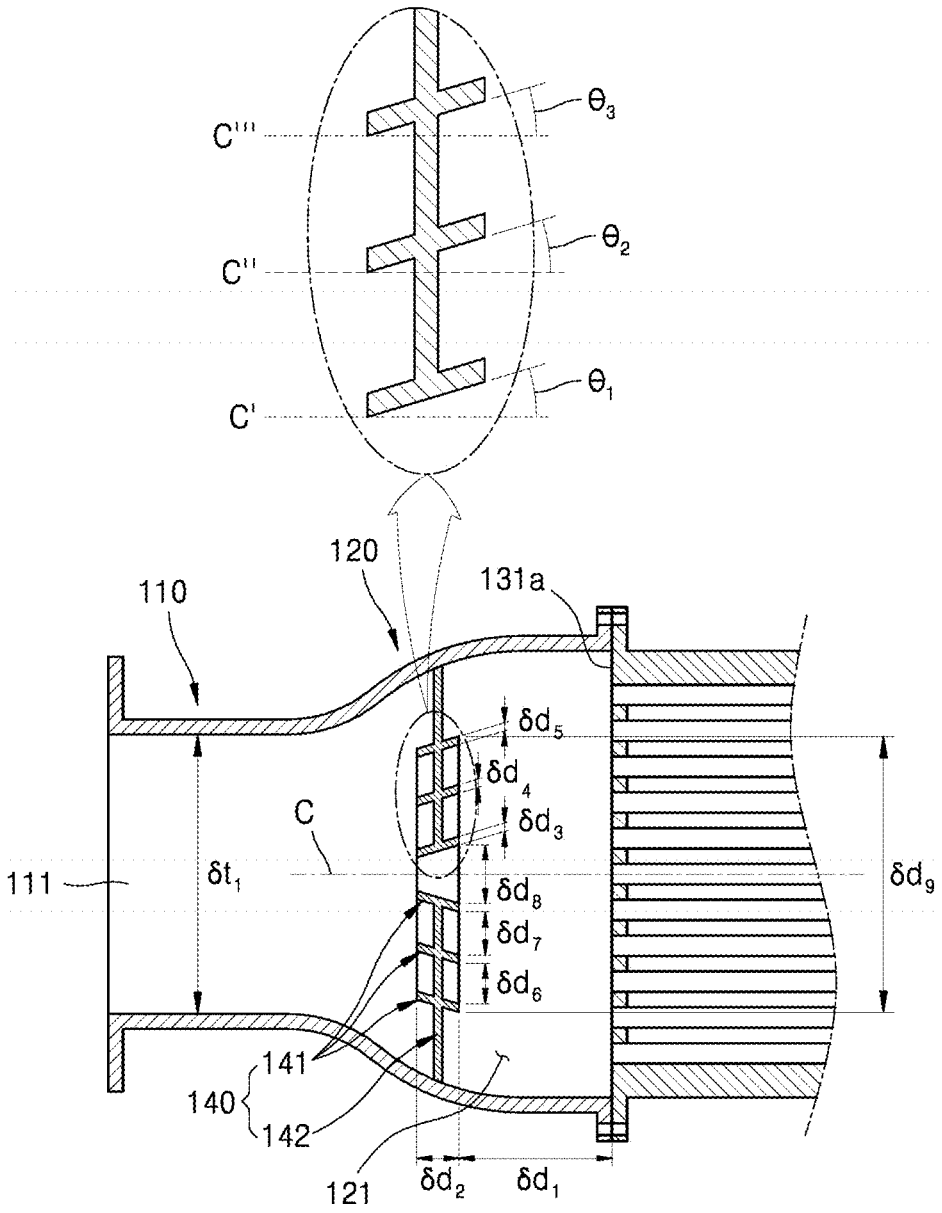

[FIG. 4A]
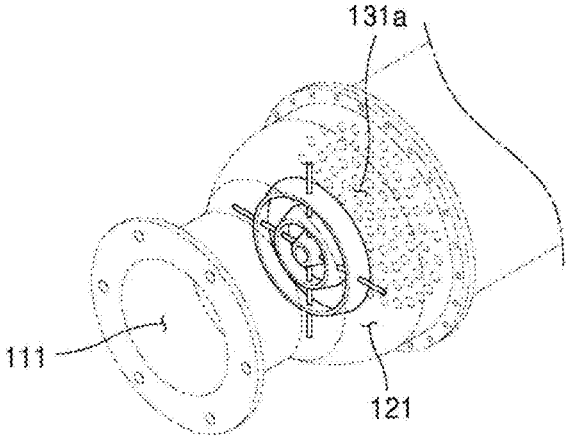
[FIG. 4B]
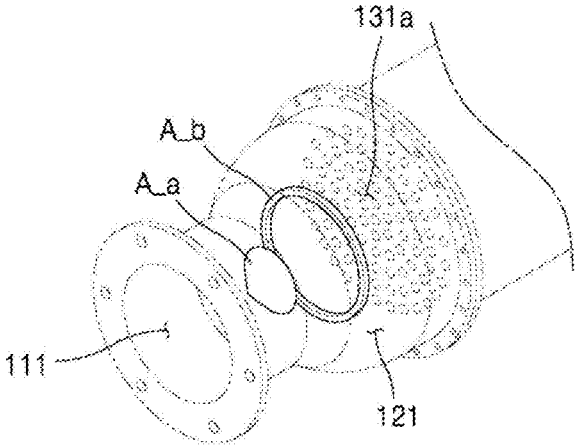
[FIG. 4C]
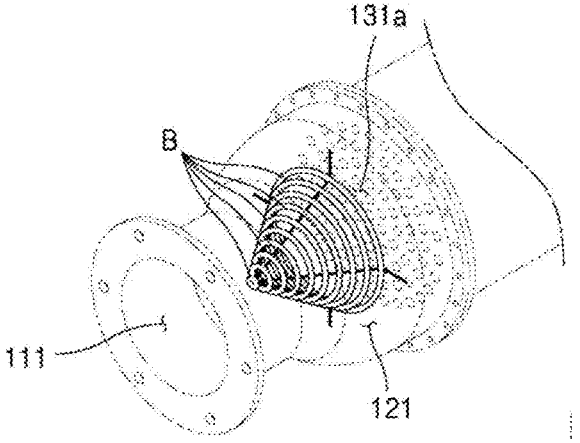

[FIG. 5A]
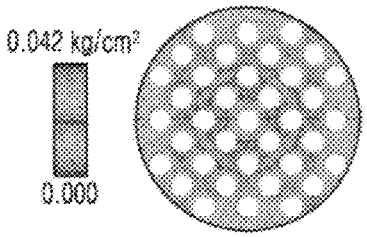
[FIG. 5B]
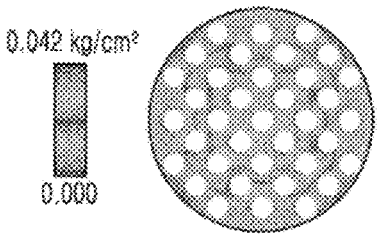
[FIG. 5C]
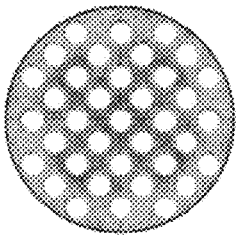
[FIG. 6A]
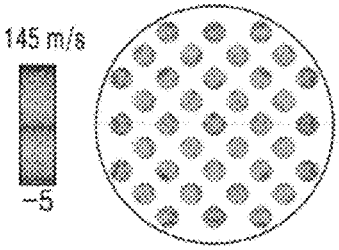
[FIG. 6B]
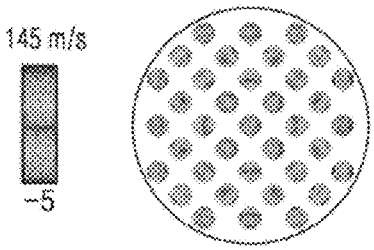
[FIG. 6C]
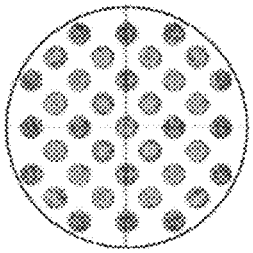
[FIG. 7A]
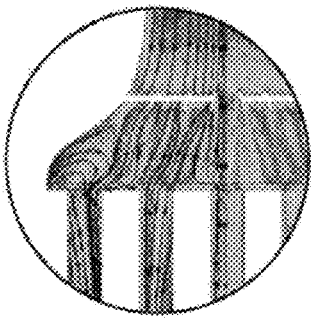
[FIG. 7B]
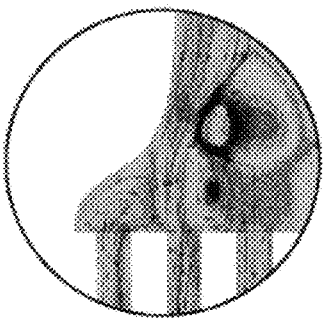
[FIG. 7C]
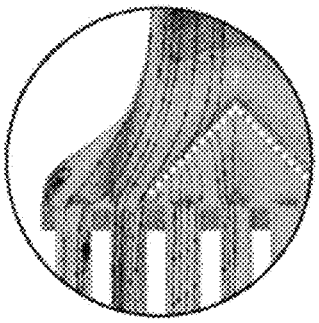

HEAT EXCHANGER

CROSS-REFERENCE TO RELATED APPLICATIONS

This application is a U.S. national stage of international Application No. PCT/KR2018/014009 filed Nov. 15, 2018, and claims priority from Korean patent Application No. KR 10-2017-0154062 filed Nov. 17, 2017, the contents of which are incorporated in their entirety as if fully set forth herein.

TECHNICAL FIELD

Exemplary embodiments of the present invention relate to a heat exchanger, and particularly, to a heat exchanger in which a fluid flow distributor is disposed at a front side of a fluid inlet of a main body of the heat exchanger so as to improve uniformity of a fluid to be introduced into the main body in order to allow the fluid, which is to be introduced into the main body of the heat exchanger where heat exchange is performed, to uniformly pass through the main body, thereby implementing efficient heat exchange.

BACKGROUND

A shell and tube heat exchanger (STHX) is a heat exchanger which is most widely used at present. The shell and tube heat exchanger has high durability, and thus operates at a temperature of −250° C. to 800° C. and under a pressure of 6,000 psi, such that the shell and tube heat exchanger is widely used in large-scale industrial fields such as power stations and oil refineries.

In general, a process of designing most of the heat exchangers starts on the assumption that a fluid, which flows to a main body of the heat exchanger where heat exchange is performed, is uniformly distributed. However, in the case of an actual heat exchanger, a flow rate of the fluid, which is introduced into a tube where heat exchange is actually performed, greatly varies due to a geometric shape of the heat exchanger or operational conditions when the heat exchanger is in operation, and the variation of the flow rate greatly affects deterioration in performance of the heat exchanger.

In addition, in the case in which the flow rate of the fluid, which is introduced into the tube where the heat exchange is performed, varies, corrosion may actively occur in the heat exchanger such as at the periphery of a fluid inlet port of the tube and inside the tube during a decoking processing process for removing foreign substances (carbon compound debris, suspended substances, etc.) that settle in the heat exchanger.

Therefore, there has been proposed a technology for improving a performance of a heat exchanger by disposing an object capable of distributing a fluid flow at an inlet side of the main body of the heat exchanger in order to improve efficiency of heat exchange by increasing uniformity of the fluid flow and prevent corrosion in the heat exchanger.

SUMMARY

Exemplary embodiments of the present invention provide a heat exchanger which has a fluid flow distributor capable of uniformly distributing a flow of a fluid to be supplied to a tube of a main body of the heat exchanger where heat exchange is performed, such that it is possible to improve a performance of the heat exchanger and prevent corrosion in the heat exchanger.

A heat exchanger according to an exemplary embodiment of the present invention includes: an inlet portion which has a first flow path through which a fluid is introduced; a main body which has a shell that has an internal space and one surface that has multiple penetration holes and a cross-sectional area larger than a cross-sectional area of the first flow path, and multiple tubes, each of which is a tubular member allowing the fluid introduced through the first flow path to flow therethrough, is positioned in the internal space of the shell, and has one end portion that is in communication with the penetration hole; an expanded tube portion which connects the inlet portion and the one surface of the shell and has a second flow path having a cross-sectional area that increases in a direction toward the one surface of the shell; and a fluid flow distributor which is a device that is disposed in the second flow path and distributes the flow of the fluid, which is introduced through the first flow path, to the multiple tubes, the fluid flow distributor including multiple ring members which are concentric to one another and are spaced apart in a direction toward the inlet portion from the one surface of the shell adjacent to the expanded tube portion, in which no other member is disposed between the inlet portion and the multiple ring members.

In the present exemplary embodiment, a cross section of the ring member may have a circular shape.

In the present exemplary embodiment, the one surface of the shell may have a circular shape, and cross sections of the first flow path and the second flow path, which are taken in parallel with the one surface of the shell, each may have a circular shape.

In the present exemplary embodiment, the ring members may have the same distance between the one surface of the shell and one side surfaces of the ring members that face the one surface of the shell.

In the present exemplary embodiment, centers of concentric circles of the multiple ring members may be positioned on an imaginary centerline which is perpendicular to the one surface of the shell and runs through a center of the one surface of the shell.

In the present exemplary embodiment, the ring members may have the same distance between one side surfaces of the ring members, which face the one surface of the shell, and the other side surfaces of the ring members that face the inlet portion.

In the present exemplary embodiment, the ring members may have the same thickness between inner portions and outer portions of the ring members.

In the present exemplary embodiment, an inner portion and an outer portion of the ring member may be inclined toward an inner surface of the second flow path in a direction toward the one surface of the shell.

In the present exemplary embodiment, a diameter of at least one of the multiple ring members may be larger than a diameter of the first flow path.

According to the heat exchanger according to the exemplary embodiments of the present invention, the fluid flow distributor uniformly distributes the flow of the fluid, which is introduced into the heat exchanger, to the tube of the main body where heat exchange is performed, such that it is possible to improve efficiency of heat exchange, prevent corrosion in the heat exchanger, and prevent a reduction in lifespan of the heat exchanger.

BRIEF DESCRIPTION OF DRAWINGS

FIG. 1 is a schematic view illustrating a heat exchanger according to an exemplary embodiment.

FIG. 2 is a perspective view of an entire fluid flow distributor illustrated in FIG. 1.

FIG. 3 is a cross-sectional side view illustrating an interior and a periphery of an expanded tube portion including the fluid flow distributor illustrated in FIG. 2.

FIG. 4A is a schematic illustration of the interior and the periphery of the expanded tube portion of the heat exchanger including the fluid flow distributor according to the exemplary embodiment.

FIG. 4B is a schematic illustration of an interior and a periphery of an expanded tube portion of a heat exchanger including a fluid flow distributor according to Comparative Example 1.

FIG. 4C is a schematic illustration of an interior and a periphery of an expanded tube portion of a heat exchanger including a fluid flow distributor according to Comparative Example 2.

FIG. 5A illustrates the pressure distribution of a fluid measured at one surface of a shell of the heat exchanger including the fluid flow distributor according to the exemplary embodiment.

FIG. 5B illustrates the pressure distribution of a fluid which is measured at one surface of a shell of the heat exchanger including the fluid flow distributor according to Comparative Example 1.

FIG. 5C illustrates the pressure distribution of a fluid which is measured at one surface of a shell of the heat exchanger including the fluid flow distributor according to Comparative Example 2.

FIG. 6A illustrates the speed distribution of the fluid which is measured at an inlet port of a tube disposed on one surface of the shell of the heat exchanger including the fluid flow distributor according to the exemplary embodiment.

FIG. 6B illustrates the speed distribution of a fluid which is measured at an inlet port of a tube disposed on one surface of the shell of the heat exchanger including the fluid flow distributor according to Comparative Example 1.

FIG. 6C illustrates the speed distribution of a fluid which is measured at an inlet port of the tube disposed on one surface of the shell of the heat exchanger including the fluid flow distributor according to Comparative Example 2.

FIG. 7A illustrates the flow line distribution obtained by analyzing a flow rate of a fluid measured in the heat exchanger including the fluid flow distributor according to the exemplary embodiment FIG. 7B illustrates the flow line distribution obtained by analyzing a flow rate of a fluid measured in the heat exchanger including the fluid flow distributor according to Comparative Example 1.

FIG. 7C illustrates the flow line distribution obtained by analyzing a flow rate of a fluid measured in the heat exchanger including the fluid flow distributor according to Comparative Example 2.

REFERENCE NUMERALS USED IN DRAWINGS

100: Heat exchanger
110: Inlet portion
111: First flow path
120: Expanded tube portion
121: Second flow path
130: Main body
131: Shell
131*a*: One surface of shell
131*b*: The other surface of shell
132: Tube
133: Penetration hole
140: Fluid flow distributor
141: Ring member
141*a*: Inner portion
141*b*: Outer portion
142: Connecting member
142*a*: First connecting member
142*b*: Second connecting member
C: Imaginary centerline
C', C'', C''': Imaginary centerlines parallel to C

DETAILED DESCRIPTION

The present invention will be apparent with reference to exemplary embodiments to be described below in detail together with the accompanying drawings. However, the present invention is not limited to the exemplary embodiments disclosed herein but will be implemented in various forms. The exemplary embodiments are provided so that the present invention is completely disclosed, and a person of ordinary skilled in the art can fully understand the scope of the present invention. Therefore, the present invention will be defined only by the scope of the appended claims. Meanwhile, the terms used in the present specification are for explaining the exemplary embodiments, not for limiting the present invention. Unless particularly stated otherwise in the present specification, a singular form also includes a plural form. In addition, the terms such as "comprises (includes)" and/or "comprising (including)" used in the specification do not exclude presence or addition of one or more other constituent elements, steps, operations, and/or elements, in addition to the mentioned constituent elements, steps, operations, and/or elements. The terms such as "first" and "second" may be used to describe various constituent elements, but the constituent elements should not be limited by the terms. These terms are used only to distinguish one constituent element from another constituent element.

Hereinafter, exemplary embodiments of the present invention will be described in detail with reference to the accompanying drawings.

FIG. 1 is a schematic view illustrating a heat exchanger according to an exemplary embodiment of the present invention. FIG. 2 is a perspective view of an entire fluid flow distributor illustrated in FIG. 1. FIG. 3 is a cross-sectional side view illustrating an interior and a periphery of an expanded tube portion including the fluid flow distributor illustrated in FIG. 2.

As illustrated in FIGS. 1 to 3, the exemplary embodiment of the present invention relates to a heat exchanger, and to a heat exchanger 100 in which a fluid flow distributor 140 is disposed at a front side of a fluid inlet of a main body 130 so as to improve uniformity of a fluid to be introduced into the main body 130 in order to allow the fluid, which is to be introduced into the main body 130 where heat exchange is performed, to uniformly pass through the main body 130, thereby implementing efficient heat exchange.

The heat exchanger 100 according to the exemplary embodiment of the present invention may be used for a process of thermally decomposing hydrocarbon. The process of thermally decomposing hydrocarbon may be a large-scale process of producing light olefin such as ethylene and propylene which are mainly used in petrochemical industries. A supplied raw material such as naphtha, methane, ethane, propane, or butane may be thermally decomposed to create light hydrocarbon. Gas, which is produced during the process, needs to be cooled because the gas is not stable at a high temperature. In this case, the heat exchanger 100 according to the exemplary embodiment of the present invention may be used. The hydrocarbon is mentioned as an example of a fluid used for the heat exchanger 100, but the fluid is not limited to the hydrocarbon, and any type of fluid may be used as long as the fluid can be subjected to heat exchange.

The heat exchanger 100 according to the exemplary embodiment of the present invention may include an inlet portion 110 into which a fluid is introduced, a main body 130 which allows the fluid, which is introduced through the inlet portion 110, to pass through the main body 130 and exchange heat with another heat exchange medium, an expanded tube portion 120 which connects the inlet portion 110 and the main body 130, and a fluid flow distributor 140 which is disposed in the expanded tube portion 120 and distributes a flow of the fluid.

The inlet portion 110 may have a first flow path 111 through which the fluid is introduced. Here, the fluid may be high-temperature gas, and the high-temperature gas may be introduced through the first flow path 111 in a direction toward the main body 130.

The main body 130 may include a shell 131 and multiple tubes 132.

The shell 131 may have a cylindrical shape that extends in a longitudinal direction so as to form an internal space. One surface 131*a* of the shell is a surface that faces a cross section of the first flow path 111 and has a cross-sectional area larger than a cross-sectional area of the first flow path 111, and the one surface 131*a* of the shell may have multiple penetration holes 133. The other surface 131*b* of the shell is a surface that is positioned opposite to the one surface 131*a* of the shell with an internal space interposed therebetween. Similar to the one surface 131*a* of the shell, the other surface 131*b* of the shell has a cross-sectional area larger than the cross-sectional area of the first flow path, and may have multiple penetration holes 133.

Each of the multiple tubes 132 is a tubular member that serves as a flow path through which the fluid introduced through the first flow path 111 may flow in the internal space of the shell 131. The multiple tubes 132 may be positioned in the internal space of the shell 131. In detail, each of the tubes 132 may be a circular tube 132 that extends in the longitudinal direction of the shell 131. One end portion of the tube may be disposed to be in communication with the penetration hole 133 formed in the one surface 131*a* of the shell, and the other end portion of the tube may be disposed to be in communication with the penetration hole 133 formed in the other surface 131*b* of the shell. The multiple tubes 132 may be arranged to be spaced apart from one another at an equal interval. The fluid, which is introduced through the first flow path 111, may be introduced into the tube 132 through an inlet port which is one end portion of the tube 132, and the fluid may be discharged to the outside of the tube 132 through an outlet port which is the other end portion of the tube 132.

A heat exchange medium capable of cooling the tubes 132 may be accommodated in a region outside the tube 132 in the internal space of the shell 131. The fluid, which is introduced into the tube 132, may exchange heat with the heat exchange medium by means of the tubes 132. That is, the high-temperature gas, which is an example of the fluid to be introduced into the tube 132, may be cooled as the high-temperature gas exchanges heat with the heat exchange medium.

The expanded tube portion 120 may have a second flow path 121 which connects the inlet portion 110 and the one surface 131*a* of the shell 131 and has a cross-sectional area that increases in a direction toward the one surface 131*a* of the shell 131. A degree to which a cross-sectional area of the second flow path 121 increases is gradually increased in a direction from the inlet portion 110 toward the one surface 131*a* of the shell, and the degree may be gradually decreased from a predetermined point.

A material of each of the first flow path 111, the second flow path 121, and the tube 132 may be, but not limited to, aluminum or copper having excellent thermal conductivity and machine workability, stainless steel or nickel having excellent heat resistance and corrosion resistance, or a cobalt-based alloy (Inconel, Monel, etc.) because excellent heat exchange performances and durability need to be considered and flow paths through which the fluid may flow need to be easily formed. The first flow path 111 and the second flow path 121 are formed in the inlet portion 110 and the expanded tube portion 120, respectively. Regarding a method of forming the first flow path 111 and the second flow path 121, the first flow path 111 and the second flow path 121 may be formed by a process of inserting a refractory material such as a ceramic material into the inlet portion 110 and the expanded tube portion 120 and solidifying the refractory material to form the first flow path 111 and the second flow path 121.

The one surface 131*a* of the shell may have a circular shape, and a cross section of each of the first flow path 111 and the second flow path 121, which is made by cutting each of the first flow path 111 and the second flow path 121 in a direction parallel to the one surface 131*a* of the shell, may be a circular shape. The one surface 131*a* of the shell may be a flat surface formed in a direction perpendicular to the longitudinal direction of the main body 130.

Meanwhile, in the case of the fluid introduced into the second flow path 121 through the first flow path 111, since the second flow path 121 has a larger cross-sectional area than the first flow path 111, a flow rate distribution in the second flow path 121 may be concentrated at a central region corresponding to the first flow path 111, and a flow velocity may also be higher in the central region than in a peripheral region. For this reason, the fluid may not be uniformly introduced into the inlet ports of the multiple tubes 132 which are disposed on the one surface 131*a* of the shell.

To solve the aforementioned problem, the fluid flow distributor 140 may be disposed in the second flow path 121 in order to uniformly distribute the flow of the fluid to the penetration holes 133 that are in communication with the tubes 132, respectively. The fluid flow distributor 140 may be disposed to be closer to the first flow path 111 than the fluid flow distributor 140 is to the one surface 131*a* of the shell. The fluid flow distributor 140 may be made of a material having excellent heat resistance and corrosion resistance so that the fluid flow distributor 140 does not react with the high-temperature fluid.

The fluid flow distributor 140 may include multiple ring members 141 which are concentric to one another and are spaced apart in a direction from the one surface 131*a* of the shell, which is adjacent to the expanded tube portion 120, toward the inlet portion 110. The ring member 141 is a member having a hollow portion that enables the fluid to pass therethrough, and a cross section of the ring member 141 may have a circular shape. In detail, the cross section of the ring member 141, which is made by cutting the ring member 141 in parallel with the one surface 131*a* of the shell, may have a circular ring shape in the form of a doughnut in consideration of a thickness between an inner portion 141*a* and an outer portion 141*b*. The centers of the concentric circles of the multiple ring members 141 are spaced apart in the direction from the one surface 131*a* of the shell toward the inlet portion 110 and may be positioned on an imaginary plane parallel to the one surface 131*a* of the shell. The multiple ring members 141 have different diameters, but are concentrically disposed on the same imaginary plane, such that the flow of the fluid may be distributed and guided to a space between the two neighboring ring members 141.

The ring members 141 may have substantially the same distance δd1 between the one surface 131*a* of the shell and one side surface of the ring member 141 that faces the one surface 131*a* of the shell. The substantially equal distance means that it is possible to ignore an error which occurs as the distance may vary due to deterioration in precision during a manufacturing process even though it is intended that the ring members 141 have the same distance δd1 between the one surface 131*a* of the shell and the one side surface of the ring member 141 that faces the one surface 131*a* of the shell. The one side surfaces of the ring members 141, which face the one surface 131*a* of the shell, are spaced apart from one another in the direction from the one surface 131*a* of the shell toward the inlet portion 110 and may be positioned on an imaginary plane parallel to the one surface 131*a* of the shell. The reason is that any one ring member 141 may hinder a flow distribution of the fluid toward another ring member 141 disposed at a downstream side of the one ring member 141 if the fluid flow distributor 140 has the multiple ring members 141, the ring members 141 are arranged to be spaced apart from one another in a flow direction of the fluid, and thus the multiple ring members 141 have different distances between the one surface 131*a* of the shell and the one side surface of the ring member 141 that faces the one surface 131*a* of the shell.

The centers of the concentric circles of the multiple ring members 141 may be positioned on an imaginary centerline C that runs through the center of the one surface 131*a* of the shell and is perpendicular to the one surface 131*a* of the shell. The center of the cross section of the first flow path 111, which is taken in parallel with the one surface 131*a* of the shell, may be positioned on the centerline C. The center of the cross section of the second flow path 121, which is taken in parallel with the one surface 131*a* of the shell, may be positioned on the centerline C. That is, the center of the cross section of the first flow path 111, the center of the cross section of the second flow path 121, the centers of the concentric circles of the multiple ring members 141, and the center of the one surface 131*a* of the main body may be positioned on the centerline C.

The ring members 141 may have the same distance δd2 between the one side surfaces of the ring members 141, which face the one surface 131*a* of the shell, and the other side surfaces of the ring members 141 which face the inlet portion 110.

The inner portion 141*a* and the outer portion 141*b* of the ring member 141 may be inclined toward an inner surface of the second flow path 121 in the direction toward the one surface 131*a* of the shell. The inner portion 141*a* and the outer portion 141*b* of at least one of the multiple ring members 141 may be inclined toward the inner surface of the second flow path 121 in the direction toward the one surface 131*a* of the shell. The ring members 141, which have the inclined inner portions 141*a* and the inclined outer portions 141*b*, may have different gradients or the same gradient that indicates a degree to which the inner portions 141*a* and the outer portions 141*b* of the ring members 141 are inclined. In the case in which the ring members 141 have the different gradients, the ring member 141 disposed at a relatively outer side may have a larger gradient. That is, an angle θ2, which is formed, in the ring member 141 disposed at the outer side, with respect to an imaginary line C" parallel to the imaginary centerline C, may be larger than an angle θ1 which is formed, in the ring member 141 disposed at an inner side, with respect to an imaginary centerline C'. An angle θ3, which is formed, in the ring member 141 disposed outside the aforementioned ring members 141, with respect to an imaginary line C"' parallel to the imaginary centerline C, may be larger than the angle θ2. A cross-sectional area of the second flow path 121 may be increased in the direction toward the one surface 131*a* of the shell, and thus the inner surface of the second flow path 121 may also be inclined with respect to the one surface 131*a* of the shell. The inclinations of the inner portion 141*a* and the outer portion 141*b* of the ring member 141 may serve as guides capable of dispersing the flow distribution of the fluid, which is concentrated in the central region in the second flow path 121, toward a peripheral region.

The ring members 141 may have the same thickness δd3, δd4, and δd5 between the inner portions 141*a* and the outer portions 141*b* of the ring members 141. Here, the thickness may mean a shortest distance between the inner portion 141*a* and the outer portion 141*b* of the ring member 141.

Intervals δd6 and δd7 between the two neighboring ring members 141 may be different from or equal to each other. In the case in which the intervals δd6 and δd7 between the two neighboring ring members 141 are different from each other, the interval δd6 between the two neighboring ring members 141 disposed at the comparatively outer side may be larger than the interval δd7 between the two neighboring ring members 141 disposed at the inner side. A diameter δd8 of the ring member 141, which has the smallest diameter among the multiple ring members 141, may be different from or equal to the intervals δd6 and δd7 between the ring members 141.

A diameter of at least one of the multiple ring members 141 may be larger than a diameter δt1 of the first flow path 111. That is, a diameter δd9 of the ring member, which is positioned at the outermost periphery among the multiple ring members 141, may be larger than the diameter δt1 of the first flow path 111. Here, the diameter may mean an outer diameter in consideration of the thickness of the ring member 141. In the case in which the ring member 141 is inclined as described above, the diameter may mean an outer diameter of a circle defined by the one side surface of the ring member 141 most adjacent to the one surface 131*a* of the shell. Therefore, there may be an effect in that the fluid, which is introduced from the first flow path 111 having a small cross-sectional area, may be uniformly introduced into the inlet ports of the tubes 132 which are arranged at the outer periphery of the one surface 131*a* of the shell having a large cross-sectional area.

No other member may be disposed between the inlet portion 110 and the multiple ring members 141. Here, the aforementioned member may be a member which is disposed between the inlet portion 110 and the multiple ring members 141 and may hinder the flow of the fluid. For example, the aforementioned member may be a member such as a plate-shaped member or a conical member having a volume that counteracts the flow of the fluid. No other member may be disposed even between the one surface 131*a* of the shell and the multiple ring members 141.

Meanwhile, the fluid flow distributor 140 may include first connecting members 142*a* and second connecting members 142*b*. The first connecting members 142*a* may be members that connect the multiple ring members 141. The second connecting member 142*b* may be members that at least connect the inner surface of the second flow path 121 and the ring member 141 at the outermost periphery so that the multiple ring members 141 are maintained at predetermined positions in the second flow path 121. Grooves are formed in the inner surface of the second flow path 121, and the second connecting members 142*b* are inserted into the grooves, such that the second connecting members 142*b* may be fixed to the second flow path 121. In this case, one end portion of the second connecting member 142*b* may penetrate the inner surface of the second flow path 121 and may be positioned outside the second flow path 121. Meanwhile, in a case in which a size of the groove and a size of the one end portion of the second connecting member 142*b* are equal to each other, the inner surface of the second flow path 121 may be damaged due to thermal expansion of the second connecting member 142*b* that receives heat from the high-temperature fluid. Therefore, the size of the groove may be larger than the size of the one end portion of the second connecting member 142*b*, such that a clearance is formed between the second connecting member 142*b* and the groove. Both ends of the first connecting member 142*a* are fixed to an outer surface of the ring member 141 having a small diameter and an inner surface of the ring member 141 which is adjacent to the ring member 141 having a small diameter and has a large diameter, thereby connecting the ring members. The central axes of the first connecting member 142*a* and the second connecting member 142*b*, which extend in a longitudinal direction, may coincide with each other. The multiple connecting members 142 are provided.

Examples

The present invention will be described in more detail with reference to experimental examples. The following experimental examples are provided just for explanation and do not limit the present invention.

FIGS. 4A, 4B, and 4C are transparent views illustrating an interior and a periphery of the expanded tube portion of the heat exchanger including the fluid flow distributor according to the exemplary embodiment of the present invention, an interior and a periphery of an expanded tube portion of a heat exchanger including a fluid flow distributor according to Comparative Example 1, and an interior and a periphery of an expanded tube portion of a heat exchanger including a fluid flow distributor according to Comparative Example 2.

As illustrated in FIG. 4A, the fluid flow distributor 140 according to the exemplary embodiment of the present invention is disposed in the interior of the second flow path 121 of the heat exchanger 100; as illustrated in FIG. 4B, the fluid flow distributor according to Comparative Example 1 is disposed in the interior of the second flow path 121 of the heat exchanger; and as illustrated in FIG. 4C, the fluid flow distributor according to Comparative Example 2 is disposed in the interior of the second flow path 121 of the heat exchanger. Here, in the exemplary embodiment and Comparative Examples 1 and 2, a diameter of the first flow path 111 is set to 247 mm, a length of the second flow path 121 is set to 150 mm, and a cross-sectional diameter of the shell 131 is set to 723 mm. Simulations for the following Experimental Examples 1, 2, and 3 are performed by using ANSYS Fluent v18, and regarding information associated with the fluid to be inputted into the heat exchanger, ideal gas having a flow rate of 0.778 kg/s and a temperature of 1,110 K is used.

In the exemplary embodiment, the three ring members 141 having different diameters are concentrically arranged in the second flow path 121, and both surfaces of the ring member 141 face the first flow path 111 and the one surface 131*a* of the shell, respectively. All of the ring members 141 may have the same distance between both surfaces. In addition, the inner portion 141*a* and the outer portion 141*b* of the ring member 141 are inclined toward the inner surface of the second flow path 121 in the direction toward the one surface 131*a* of the shell, and the connecting members 142, which connect the ring members, intersect each other (see FIG. 4A).

In Comparative Example 1, a conical member A_a is positioned adjacent to the first flow path 111 in the second flow path 121, and a vertex of the conical member A_a faces the first flow path 111. In addition, a circular ring A_b is positioned at a downstream side of the conical member A_a so as to be spaced apart from the conical member A_a. A diameter of the circular ring A_b is smaller than a diameter of the first flow path 111. The conical member A_a and the circular ring A-b are connected to the inner surface of the second flow path 121 and fixed in position by means of a support member that extends in a longitudinal direction. In general, the support member less affects the flow of the fluid, and as a result, the support member may be ignored when performing the experiments and analyzing the results (see FIG. 4B).

In Comparative Example 2, multiple ring members B, each of which has a diameter that gradually decreases in the direction from the one surface 131*a* of the shell toward the first flow path 111, are arranged at predetermined spacing distances so as to entirely define a conical shape. Four connecting members, which connect the multiple ring members, are bent and extended toward the inner surface of the second flow path 121 at a side close to the one surface 131*a* of the shell. Meanwhile, because Comparative Example 2 is configured such that a condition of the ring member B disclosed in U.S. Pat. No. 5,029,637 is adopted, a sum of the cross-sectional areas of the one side surfaces of the multiple ring members B which face the first flow path 111 is equal to the cross-sectional area of the first flow path 111. All of the multiple ring members B have diameters each of which is equal to or smaller than the diameter of the first flow path (see FIG. 4C).

The simulations are performed on the flow of the fluid in the second flow paths 121 of the heat exchangers 100 according to the exemplary embodiment of the present invention, Comparative Example 1, and Comparative Example 2 by allowing the fluid to pass through the first flow path 111 and the second flow path 121 and to flow into the tubes 132 of the main body 130. Standard deviations/averages associated with the results of the simulations are coefficients of variation and may mean distribution degrees of particular variables. According to the present Experimental Examples, the distribution degrees are shown at positions for measuring a pressure, a speed, and a flow rate of the fluid, and it can be considered that measured values are more uniformly distributed as a value of the standard deviation/average is smaller.

FIGS. 5A to 5C are experimental results of a pressure distribution of a fluid measured at one surface of a shell of the heat exchanger including the fluid flow distributor according to the exemplary embodiment of the present invention (FIG. 5A), according to Comparative Example 1 (FIG. 5B), and according to Comparative Example 2 (FIG. 5C). Here, the experimental result regarding the pressure distribution measured at the one surface of the shell is derived by a constant pressure analysis.

Example 1—Results of measuring pressure distributions of the fluid at the one surfaces 131*a* of the shells with respect to the exemplary embodiment, Comparative Example 1, and Comparative Example 2 (see FIGS. 5A to 5C and Table 1).

TABLE 1

| | Exemplary Embodiment | Comparative Example 1 | Comparative Example 2 |
|---|---|---|---|
| Minimum Pressure ($kg/cm^2$) | 0.006 | 0.001 | 0.004 |
| Maximum Pressure ($kg/cm^2$) | 0.025 | 0.032 | 0.024 |
| Standard Deviation/ Average | 0.520 | 0.680 | 0.467 |

Regarding the pressure distributions at the one surfaces 131*a* of the main bodies with respect to the exemplary embodiment of the present invention (see FIG. 5A), Comparative Example 1 (see FIG. 5B), and Comparative Example 2 (see FIG. 5C), it can be seen that a minimum pressure (0.006 $kg/cm^2$) of the exemplary embodiment is higher than a minimum pressure (0.001 $kg/cm^2$) of Comparative Example 1, a maximum pressure (0.025 $kg/cm^2$) of the exemplary embodiment is lower than a maximum pressure (0.032 $kg/cm^2$) of Comparative Example 1, and a standard deviation/average (0.520) of the exemplary embodiment is smaller than a standard deviation/average (0.680) of Comparative Example 1. Therefore, it can be ascertained that the pressure distribution at the one surface 131*a* of the shell is more uniform in the case of the exemplary embodiment than in the case of Comparative Example 1. Meanwhile, when comparing the exemplary embodiment and Comparative Example 2, a value of the standard deviation/average at the one surface 131*a* of the main body is larger in the exemplary embodiment than in Comparative Example 2, such that it may be considered that Comparative Example 2 is more uniform in terms of the pressure distribution than the exemplary embodiment. However, in terms of the uniformity of the flow distribution of the fluid, a speed distribution and a flow line distribution of the fluid, which is introduced into the tube 132 where heat exchange is directly performed, are more substantially meaningful than the pressure distribution of the fluid at the one surface 131*a* of the shell, and as a result, the speed distribution and the flow line distribution of the fluid will be described below.

FIGS. 6A to 6C are experimental results of a speed distribution of the fluid which is measured at an inlet port of a tube disposed on one surface of the shell of the heat exchanger including the fluid flow distributor according to the exemplary embodiment of the present invention (FIG. 6A), according to Comparative Example 1 (FIG. 6B), and according to Comparative Example 2 (FIG. 6C).

Experimental Example 2—Results of measuring the speed distributions of the fluid in a direction perpendicular to the one surfaces 131*a* of the shells at the inlets of the tubes 132 formed on the one surfaces 131*a* of the shells with respect to the exemplary embodiment, Comparative Example 1, and Comparative Example 2 (see FIGS. 6A to 6C and Table 2).

TABLE 2

| (m/s) | Exemplary Embodiment | Comparative Example 1 | Comparative Example 2 |
|---|---|---|---|
| Minimum Speed (m/s) | 0 | −4.60 | 0 |
| Maximum Speed (m/s) | 115.70 | 140.25 | 120.90 |
| Standard Deviation/ Average | 0.212 | 0.358 | 0.244 |

Referring to the speed distributions of the fluid in the direction perpendicular to the one surfaces 131*a* of the shells at the inlet ports of the tubes 132 disposed on the one surfaces 131*a* of the shells with respect to the exemplary embodiment of the present invention (see FIG. 6A), Comparative Example 1 (see FIG. 6B), and Comparative Example 2 (see FIG. 6C), a maximum speed (115.70 m/s) and a standard deviation/average (0.212) of the exemplary embodiment are lowest in comparison with a maximum speed (140.25 m/s) and a standard deviation/average (0.358) of Comparative Example 1 and a maximum speed (120.90 m/s) and a standard deviation/average (0.244) of Comparative Example 2. The configuration in which the maximum speed and the standard deviation/average of the exemplary embodiment are small may mean that a flow velocity at the inlet port of the tube 132, into which the fluid is introduced fastest among the inlet ports of the multiple tubes 132 disposed on the one surface 131*a* of the shell, is lower than a flow velocity of Comparative Example 1 and a flow velocity of Comparative Example 2, and the speed distribution of the exemplary embodiment with respect to the fluid introduced into the multiple tubes 132 is more uniform than the speed distribution of Comparative Example 1 and the speed distribution of Comparative Example 2. Therefore, it can be said that in the case of the exemplary embodiment, the fluid is uniformly supplied into the entire multiple tubes 132, and the flow of the fluid is more uniform. In addition, the minimum speed (−4.60) has a negative value in the case of Comparative Example 1, and as a result, it can be seen that a reverse flow occurs at the one surface 131*a* of the shell. The minimum speed is 0 in the case of the exemplary embodiment, and as a result, it can be seen that no reverse flow occurs.

FIGS. 7A to 7C are experimental results of a flow line distribution obtained by analyzing a flow rate of a fluid measured in the heat exchanger including the fluid flow distributor according to the exemplary embodiment of the present invention (FIG. 7A), according to Comparative Example 1 (FIG. 7B), and according to Comparative Example 2 (FIG. 7C).

Experimental Example 3—Results of measuring flow distributions and flow line distributions of a fluid in the second flow paths 121 and at the periphery of the second flow paths 121 with respect to the exemplary embodiment, Comparative Example 1, and Comparative Example 2 (see FIGS. 7A to 7C and Table 3).

TABLE 3

| | Exemplary Embodiment | Comparative Example 1 | Comparative Example 2 |
|---|---|---|---|
| Minimum Flow Rate (kg/s) | 0.034 | 0.032 | 0.034 |
| Maximum Flow Rate (kg/s) | 0.049 | 0.058 | 0.053 |

TABLE 3-continued

| | Exemplary Embodiment | Comparative Example 1 | Comparative Example 2 |
|---|---|---|---|
| Standard Deviation/ Average | 0.117 | 0.240 | 0.164 |

Referring to the flow distributions and the flow line distributions of the fluid in the second flow path 121 and at the periphery of the second flow path 121 with respect to the exemplary embodiment of the present invention (see FIG. 7A), Comparative Example 1 (see FIG. 7B), and Comparative Example 2 (see FIG. 7C), it can be seen that a minimum flow rate (0.034 kg/s) of the exemplary embodiment is similar to a minimum flow rate (0.032 kg/s) of Comparative Example 1 and a minimum flow rate (0.034 kg/s) of Comparative Example 2, a maximum flow rate (0.049 kg/s) of the exemplary embodiment is lower than a maximum flow rate (0.058 kg/s) of Comparative Example 1 and a maximum flow rate (0.053 kg/s) of Comparative Example 2, and a standard deviation/average (0.117) of the exemplary embodiment is smaller than a measured value (0.240) of Comparative Example 1 and a measured value (0.164) of Comparative Example 2. Therefore, it can be said that a difference between the maximum flow rate and the minimum flow rate and the standard deviation/average are smaller in the case of the exemplary embodiment than in the case of Comparative Example 1 and Comparative Example 2, such that the flow line distribution is uniform in the case of the exemplary embodiment. In addition, it can be seen that in the case of Comparative Example 1, a vortex flow occurs around the conical distributor. It can be seen that in the case of Comparative Example 2, vortex flows occur at an outermost peripheral portion of the second flow path 121 and in the tube 132. The vortex flow in the second flow path 121 may increase a likelihood that foreign substances (carbon compound debris, etc.) settle in the second flow path 121, and the vortex flow in the tube 132 may degrade a heat exchange performance. It can be seen that in the case of the exemplary embodiment, no vortex flow occurs unlike Comparative Examples 1 and 2.

An example of an operation of the heat exchanger 100 according to the exemplary embodiment of the present invention will be described below.

The fluid may be introduced into the second flow path 121 of the expanded tube portion 120 and the multiple tubes 132 of the main body 130 through the first flow path 111 formed in the inlet portion 110. The flow of the fluid is distributed as the fluid passes through the fluid flow distributor 140 disposed in the second flow path 121, and the fluid may be uniformly introduced into the tubes 132 through the penetration holes 133 formed in the one surface 131*a* of the shell having a large area. The fluid passes through the multiple tubes 132 of the main body, such that the fluid may smoothly exchange heat with the heat exchange medium accommodated in the shell 131 of the main body 130 by means of the tubes 132.

The heat exchanger 100 according to the exemplary embodiment of the present invention has the following effects.

The fluid flow distributor 140 distributes the flow of the fluid and may allow the fluid to be uniformly introduced into the multiple tubes 132 of the main body 130, thereby implementing efficient heat exchange.

The fluid to be introduced into the heat exchanger 100 may include hydrocarbon. The hydrocarbon may be deposited in the heat exchanger 100. When the flow of the fluid is not uniform due to the occurrence of vortex flows in the second flow path 121 and the tube 132, the hydrocarbon may be deposited in the second flow path 121 and the tube 132, which causes a vicious circle in which the tube 132 is clogged or the inner wall of the second flow path 121 becomes thicker and thereby the flow of the fluid becomes more non-uniform. The fluid flow distributor 140 prevents a vortex flow from occurring in the second flow path 121 and the tube 132, thereby preventing the deposition of the hydrocarbon in the heat exchanger.

The ring members 141 may have the same distance δd1 between the one surface 131*a* of the shell and the one side surfaces of the ring members 141 that face the one surface 131*a* of the shell, and as a result, the multiple ring members 141 may not be arranged so as to be spaced apart from one another in the flow direction of the fluid. Therefore, the flow of the fluid, which is introduced between the respective ring members 141, may not be hindered.

No other member may be disposed between the inlet portion 110 and the multiple ring members 141, and as a result, the flow of the fluid may not be hindered.

While the present invention has been described with reference to the aforementioned exemplary embodiments, various modifications or alterations may be made without departing from the subject matter and the scope of the invention. Accordingly, the appended claims include the modifications or alterations as long as the modifications or alterations fall within the subject matter of the present invention.

The invention claimed is:

1. A heat exchanger comprising:

an inlet portion having a first flow path, wherein a fluid is introduced through the first flow path of the inlet portion;

a main body comprising a shell and a plurality of tubes, wherein the shell has an internal space and one surface having a plurality of penetration holes and a cross-sectional area larger than a cross-sectional area of the first flow path, wherein each of the plurality of tubes is a tubular member allowing the fluid introduced through the first flow path to flow therethrough, wherein each of the plurality of tubes is positioned in the internal space of the shell, and wherein each of the plurality of tubes has one end portion that communicates with one of the plurality of penetration holes;

an expanded tube portion connecting the inlet portion and the one surface of the shell, wherein the expanded tube portion has a second flow path having a cross-sectional area that increases in a direction toward the one surface of the shell; and a fluid flow distributor disposed in the second flow path, and distributing the fluid introduced through the first flow path to the plurality of tubes, wherein the fluid flow distributor comprises a plurality of ring members, a plurality of first connecting members and a plurality of second connecting members, wherein the plurality of ring members are concentric and spaced apart from each other in a direction parallel to the one surface of the shell, and wherein the plurality of ring members are disposed adjacent to the expanded tube portion, wherein the plurality of the first connecting members connect the plurality of ring members, and wherein the plurality of second connecting members at least connect an inner surface of the second flow path and the plurality of ring members at an outermost periphery so that the plurality of ring members are maintained at predetermined positions in the second flow path, and wherein no other member is disposed between the inlet portion and the plurality of ring members.

2. The heat exchanger of claim 1, wherein a cross section of each of the plurality of ring members has a circular shape.

3. The heat exchanger of claim 1, wherein the one surface of the shell has a circular shape, wherein the cross section of each of the first flow path and the second flow path is circular, and wherein the first flow path and the second flow path are parallel with the one surface of the shell.

4. The heat exchanger of claim 1, wherein a distance between the one surface of the shell and a side surface of each of the plurality of ring members that faces the one surface of the shell is the same for each of the plurality of ring members.

5. The heat exchanger of claim 1, wherein a plurality of centers of concentric circles of the plurality of ring members are positioned on an imaginary centerline which is perpendicular to the one surface of the shell and runs through a center of the one surface of the shell.

6. The heat exchanger of claim 1, wherein a distance between a first side surface of each of the plurality of ring members that faces the one surface of the shell and a second side surface of each of the plurality of ring members that face the inlet portion is the same for each of the plurality of ring members.

7. The heat exchanger of claim 1, wherein the plurality of ring members have a same thickness between an inner portion and an outer portion of each of the plurality of ring members.

8. The heat exchanger of claim 1, wherein an inner portion and an outer portion of each of the plurality of ring members are inclined toward an inner surface of the second flow path in a direction toward the one surface of the shell.

9. The heat exchanger of claim 2, wherein a diameter of at least one of the multiple ring members is larger than a diameter of the first flow path.

* * * * *